US006362564B1

(12) United States Patent
Kim

(10) Patent No.: US 6,362,564 B1
(45) Date of Patent: Mar. 26, 2002

(54) COLOR CATHODE RAY TUBE WITH PRESCRIBED NECK THICKNESS

(75) Inventor: Youn-Jin Kim, Seoul (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/120,459

(22) Filed: Jul. 23, 1998

(30) Foreign Application Priority Data

Jul. 26, 1997 (KR) ..... 97-35340

(51) Int. Cl.[7] ..... H01J 31/00; H01R 13/46

(52) U.S. Cl. ..... 313/477 R; 313/477 HC; 445/45; 65/138

(58) Field of Search ..... 313/477 R, 482, 313/477 HC, 318.01, 318.05, 318.06, 318.08; 445/45; 439/602, 618; 65/138, 155

(56) References Cited

U.S. PATENT DOCUMENTS 4,066,310 A * 1/1978 Palac ..... 65/138
4,723,979 A * 2/1988 Fitzke et al. ..... 65/138
4,781,639 A * 11/1988 Miono ..... 445/45
5,818,155 A * 10/1998 Kawamura et al. ... 313/447 HC
5,898,264 A * 4/1999 Nose et al. ..... 313/477 HC

FOREIGN PATENT DOCUMENTS

JP 58133742 A 8/1983 ..... H01J/9/39
JP 01159931 A 6/1989 ..... H01J/9/32
JP 05028918 A 2/1993 ..... H01J/9/32

* cited by examiner

*Primary Examiner*—Michael H. Day

(57) ABSTRACT

A color cathode ray tube having a panel to which a fluorescent layer is applied, a slim neck portion with an electron gun, a funnel joined to the panel, and a stem with the electron gun sealed to the neck portion, wherein if an inner diameter of the neck portion and an outer diameter of the stem equal a and f, respectively, an interval between the neck portion's inner diameter and the stem's outer circumference meets the condition of $0.2 \leqq (a-f)/2 \leqq 3.0$, and the neck portion's outer diameter equals 23.0 mm to 28.5 mm.

5 Claims, 5 Drawing Sheets

COLOR CATHODE RAY TUBE WITH PRESCRIBED NECK THICKNESS

BACKGROUND OF THE INVENTION

1. Field of the Invention

The present invention relates to a color cathode ray tube. More particularly, it relates to a color cathode ray tube having a slim neck portion and a stem with an electron gun optimally joined to the neck portion.

2. Discussion of Related Art

Generally, a cathode ray tube of FIG. 1 includes a fluorescent layer 20, a panel 10 having a shadow mask 30 spaced a given distance away from fluorescent layer 20, a funnel 40 having a slim neck portion 40*a* at the rear and secured to panel 10, an electron gun 50 housed in the neck portion 40*a* and emitting an electron beam 70 to the fluorescent layer 20, and a stem 60 sealed to neck portion 40*a* and executing the exhaust stroke through an exhaust pipe 60*a* provided to the stem 60.

There is a deflection yoke 80 on the outer circumference of neck portion 40*a* of the cathode ray tube for deflecting an electron beam 70 emitted from electron gun 50. When a heater in a cathode (not shown) on stem 60 of electron gun 50 emits, an oxide compound, applied to the upper surface of a cathode, emits electrons. The electrons emitted from the oxide compound of the cathode pass through the respective electrodes and form an electron beam 70 of required characteristics. The electron beam 70 is deflected by a magnetic field created by deflection yoke 80, and passes through shadow mask 30 and hits on fluorescent layer 20 applied to the inside of panel 10 so that fluorescent layer 20 emits light to represent an image.

The cathode ray tube maintains a vacuum condition to smoothly perform the above operation, and stem 60 with a plurality of stem pins 90 for supplying power to electron gun 50 and exhaust pipe 60*a* for exhaust is assembled to neck portion 40*a*. The interior of the cathode ray tube is evacuated via exhaust pipe 60*a,* and thereafter exhaust pipe 60*a* is melted and sealed to maintain a vacuum condition.

The smaller the diameter of neck portion 40*a* becomes, the smaller the electric current that flows across the coil constituting deflection yoke 80. The deflection yoke 80 creates a magnetic field when electron gun 50 operates in order that the electron beam emitted from electron gun 50's oxide compound approaches fluorescent layer 20 applied to panel 10, Much research and developments have been made to minimize the diameter of neck portion 4*a,* but there is a limit to the amount of diameter reduction of a neck portion 40*a.*

First, as the diameter of neck portion 40*a* is reduced, the resolution of the electron gun is degraded yet, a high-performance electron gun of optimum design is desirable. Astigmatism that may occur by the deflection yoke by supplying focus voltages divided into two, thus compensating the resolution degradation around the screen peripheral part and optimizing a main lens. This enhances the uniformity of spots and assures high-performance of the electron gun. According to the techniques of dividing the focus voltage into two, the focus voltage is applied to a single stem pin to be divided into more than two voltages by a resistor mounted on the electron gun of the neck portion, and each focus voltage is applied through two focus voltage applying pins.

Second, as the diameter of neck portion 40*a* is reduced, the shape and size of the stem with metal pins for supplying one or two focus voltages and the required power to the electron gun need to be more precisely set, If not, a proper seal is not formed at the joint of stem 6 and neck portion 40*a*. Even if the seal is properly formed, cracks may form such that the interior of the cathode ray tube is not in a perfect vacuum state and causes poor internal voltage characteristics due to the improper sealing.

In stem 6, metallic stem pins 9 are equidistantly disposed in a circular formation on the middle of stem 6 to provide the proper insulation, and the diameter of the circular information formed by the stem pins 9 is about 15.24 mm or 12.00 mm. A glass projection 6*b* is integrally formed with stem 6 around stem pins 9 in order to increase the strength and insulating characteristics the metallic stem pins 9. When employing a slim neck portion 4*a,* stem 6 having a pin circle of 15.24 mm in diameter has a larger outer diameter than the neck portion 4*a*'s inner diameter such that glass projection 6*b* comes in contact with neck portion 4*a* to cause cracking thereof or result in poor internal voltage characteristics.

Stem 6 having a circular information of 12.0 mm in diameter has an outer diameter that is much smaller than the inner diameter of neck portion 4*a* to this not form a proper seal. Even if the seal is formed; the sealed portion is too this, which is susceptible to cracking when forming a vacuum within the cathode ray tube.

SUMMARY OF THE INVENTION

Accordingly, the present invention is directed to a color cathode ray tube that substantially obviates one or more of the problems due to limitations and disadvantages of the related art.

An object of the present invention is to provide a cathode ray tube with a slim neck portion and a stem. Each having an optimum size for sealing.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention provides a color cathode ray tube having a panel to which a fluorescent layer is applied, a slim neck portion receiving an electron gun therein, a funnel joined to the panel, and a stem with the electron gun sealed to the neck portion, wherein if an inner diameter of the neck portion and an outer diameter of the stem equal a and f, respectively, an interval between the neck portion's inner diameter a and the stem's outer circumference meets the condition of $0.2\ \text{mm} \leqq (a-f)/2 \leqq 30.0\ \text{mm}$, and the neck portion's outer diameter equals 23.0 mm to 28.5 mm.

According to another aspect of the present invention, in a color cathode ray tube having a panel to which a fluorescent layer is applied, a slim neck portion with an electron gun, therein a funnel joined to the panel, and a stem with the electron gun sealed to the neck portion, if an inner diameter of the neck portion and an outer diameter of the stem equal a and f, respectively, an interval between the neck portion's inner diameter and the stem's outer circumference meets the condition of $0.85\ a\ \text{mm} \leqq f \leqq 0.98\ a\ \text{mm}$.

According to still another aspect of the present invention, in a color cathode ray tube having a panel to which a fluorescent layer is applied, a slim neck portion with an electron gun, therein a funnel joined to the panel, and a stem with the electron gun sealed to the neck portion, if an outer diameter of the neck portion and a thickness of the neck portion equal b and t, respectively, they meet the condition of 0.08 b mm≦t≦0.1 b mm, and an outer diameter of the neck portion is 23.0 to 28.5 mm.

According to a further aspect of the present invention, in a color cathode ray tube having a panel to which a fluorescent layer is applied, a slim neck portion receiving an electron gun, therein, a funnel joined to the panel, and a stem with the electron gun sealed to the neck portion, if a thickness of the neck portion and a thickness of the stem equal t and T, respectively, they meet the condition of 0.8 tmm≦T≦1.4 tmm.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

DETAILED DESCRIPTION OF PREFERRED EMBODIMENT

Reference will now be made in detail to the preferred embodiments of the present invention, examples of which are illustrated in the accompanying drawings.

Figure 1:
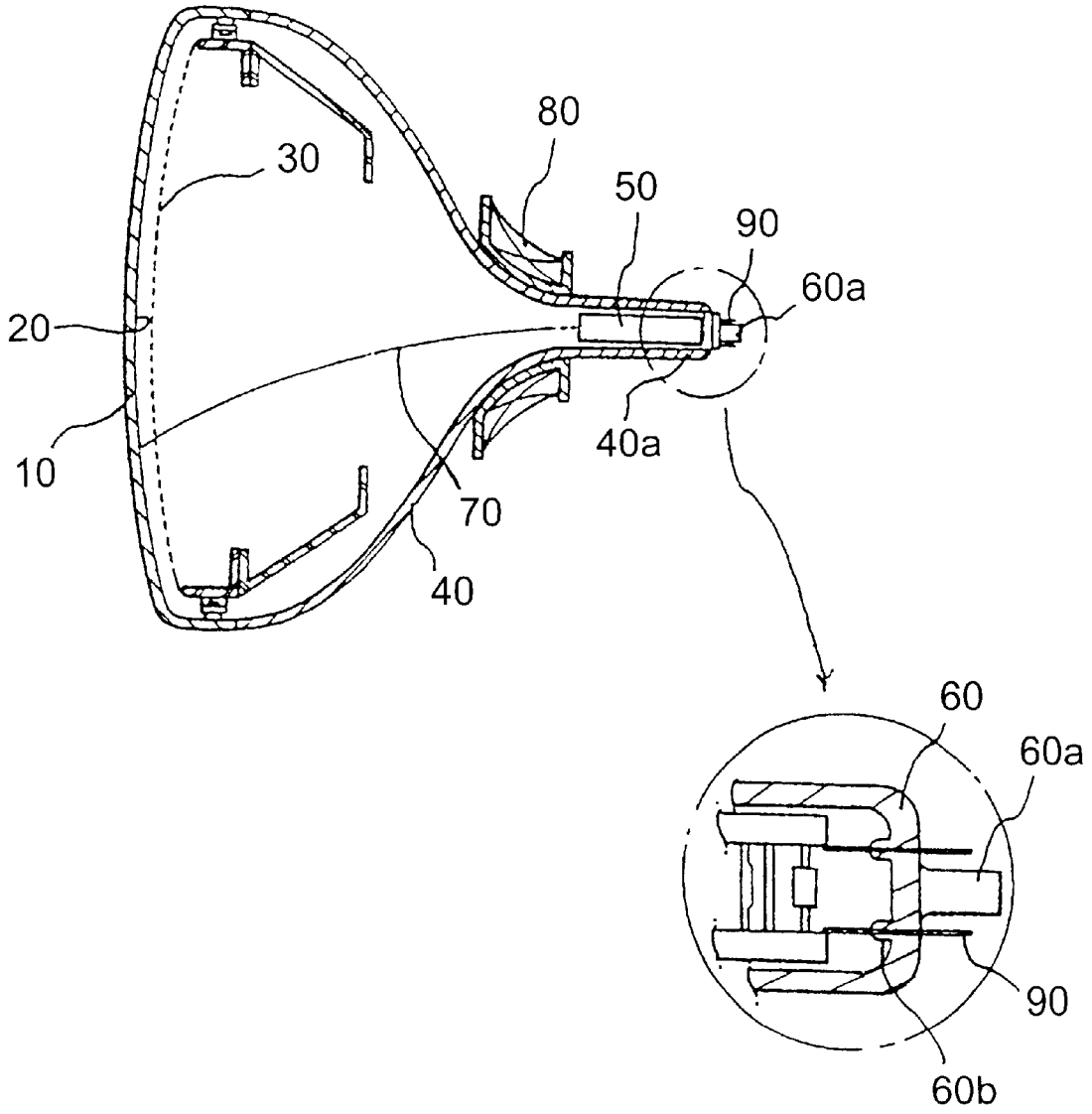
FIG. 1 PRIOR ART
FIG. 1 is a longitudinal sectional view of a conventional cathode ray tube.
Figure 2A:
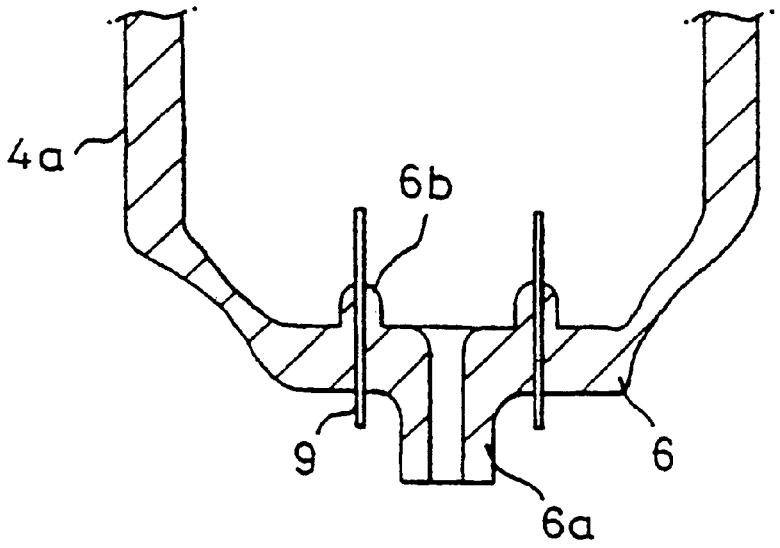
FIGS. 2A and 2B are each longitudinal sectional views of a poorly-joined cathode ray tube due to a space from between the neck portion's inner diameter and the stem's outer circumference.
Figure 2B:
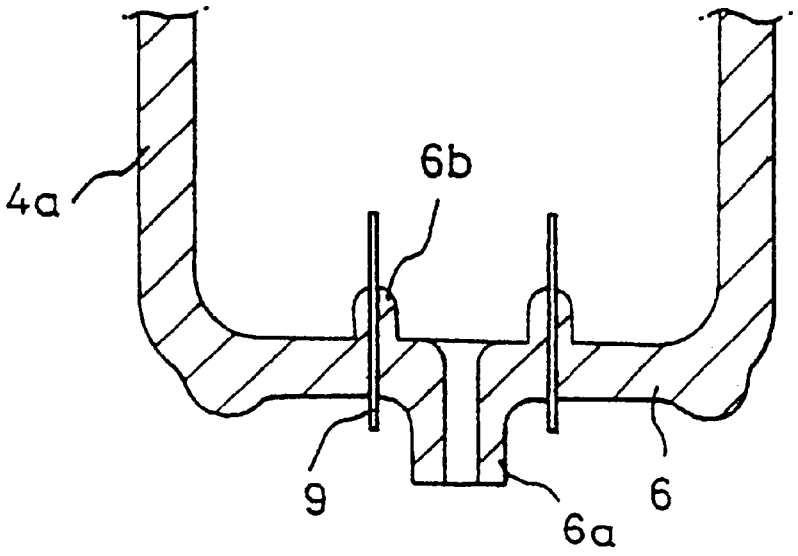
Figure 3A:
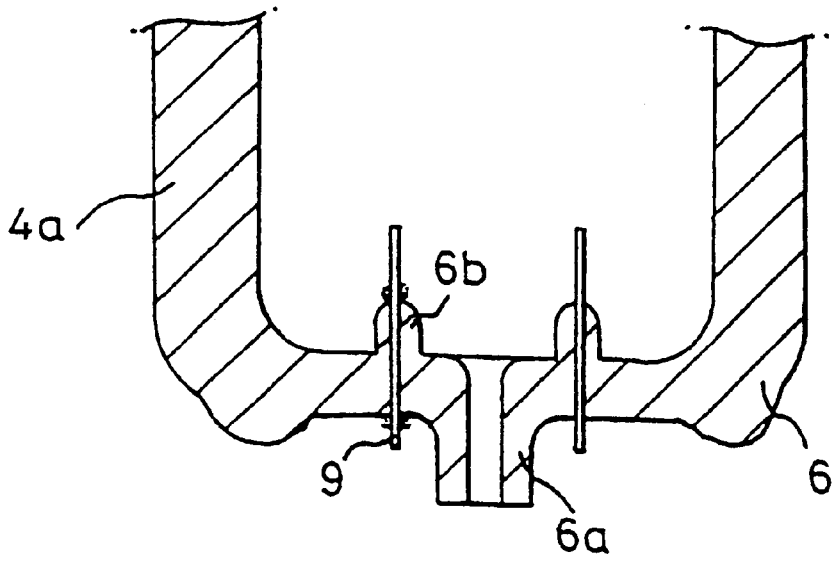
FIGS. 3A and 3B are each longitudinal sectional views of a poorly-joined cathode ray tube according to a variation in the thickness of the neck portion.
Figure 3B:
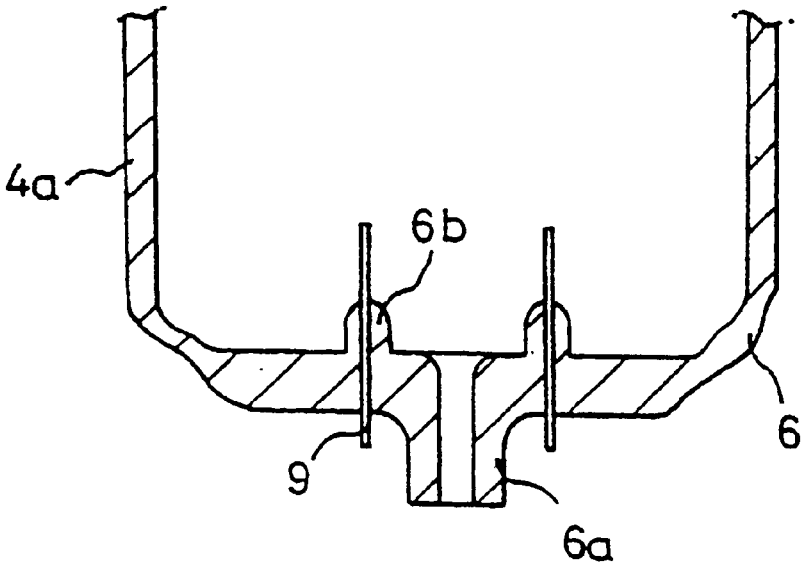
Figure 4A:
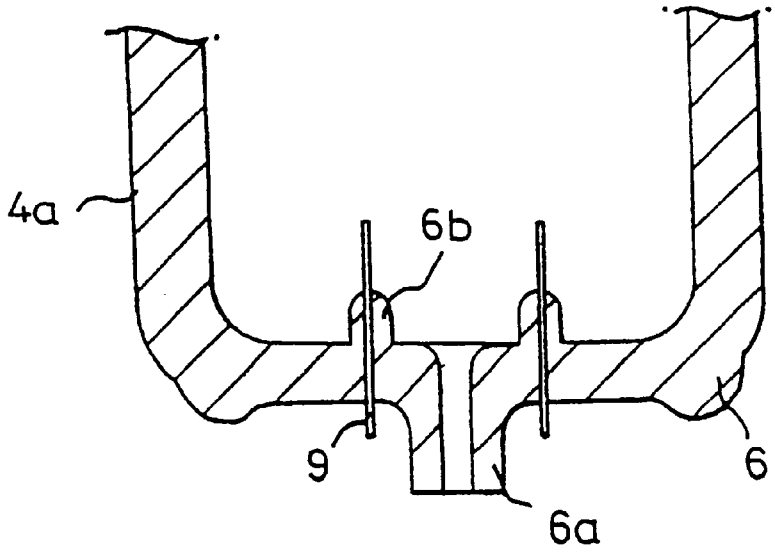
FIGS. 4A and 4B are each longitudinal sectional views of a poorly-joined cathode ray tube according to a variation in the thickness of the stem portion.
Figure 4B:
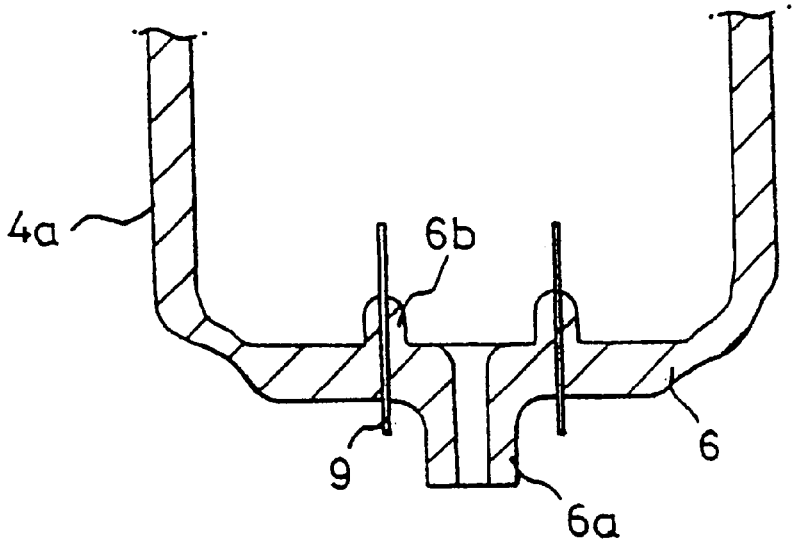
Figure 5:
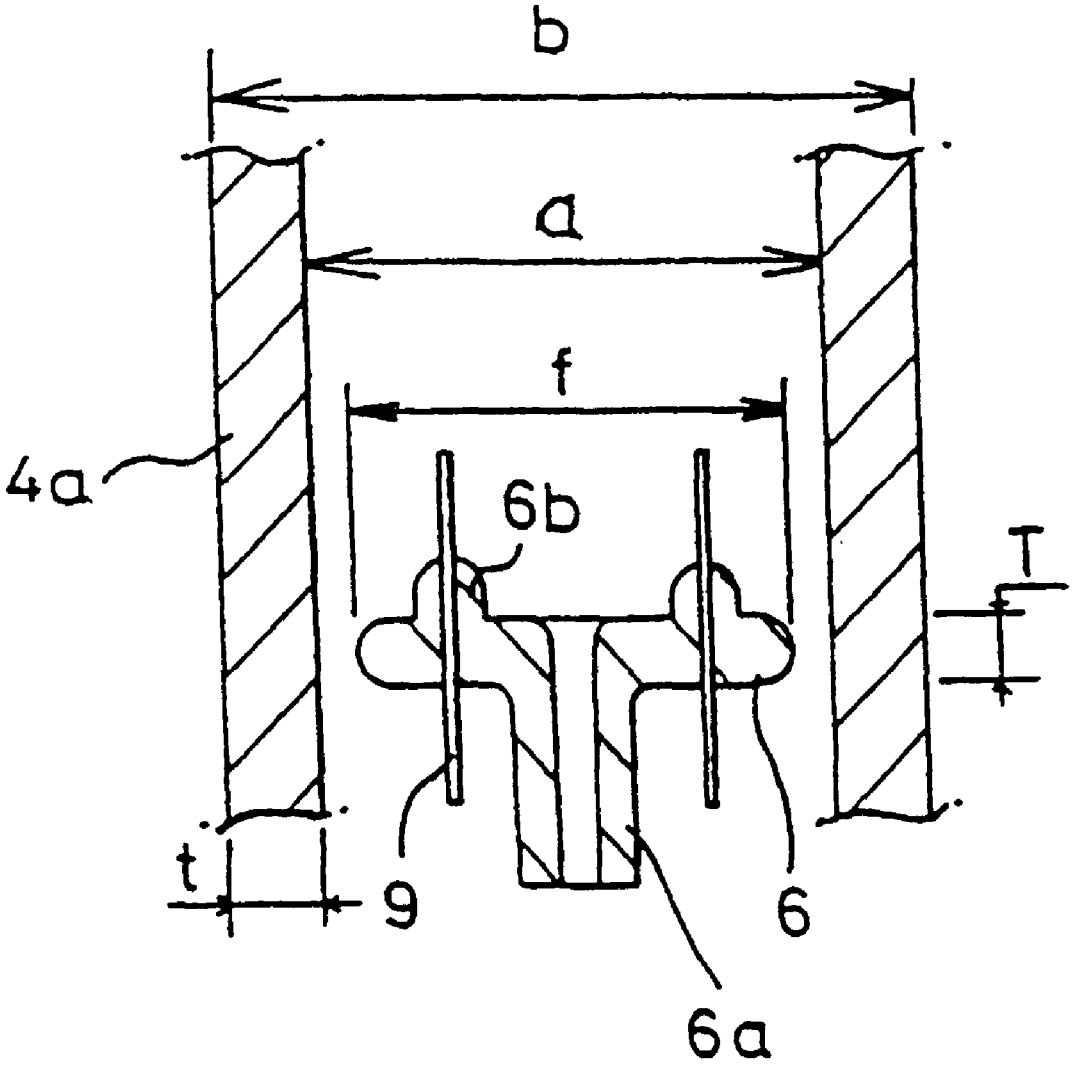
FIG. 5 is a longitudinal sectional view of a cathode ray tube before a stem is joined to a neck portion.

FIGS. 2A and 2B are each longitudinal sectional views of the poorly-joined cathode ray tube according to a neck portion's inner diameter and stem's outer circumference, and FIGS. 3A and 3B are each longitudinal sectional views of the poorly-joined cathode ray tube according to a variation in the thickness of the neck portion. FIGS. 4A and 4B are each longitudinal sectional views of the poorly-joined cathode ray tube according to a variation in the thickness of the stem portion. FIG. 5 is a longitudinal sectional view of a cathode ray tube before a stem is joined to a neck portion.

Metallic stem pins 9 of a stem 6 are equidistantly positioned on stem 6 in a circular configuration to provide the proper insulation there between. Projections 6*b,* made of the same material as that of stem 6, are integrally formed with stem 6 in order to increase the strength and enhance the insulation characteristics of stem pins 9. The circular configuration, of stem pins 9, is spaced from the inner wall of neck portion 4*a,* and the size of the stem 6 and neck portion 4*a* should be in optimum relation. Proper seal is not formed in the sealing process of joining stem 6 with the electron gun to the inside of neck portion 4*a* in the cathode ray tube with slim neck portion 4*a* having an outer diameter of less than 23.0 to 28.5 mm. Even if a proper seal is formed, a smooth shape is not made and causes deterioration that cannot satisfy the cathode ray tube.

In a first preferred embodiment of the present invention, as shown in FIG. 5, when an inner diameter of neck portion 4*a* and an outer diameter of stem 6 equal a and f, respectively, the inner diameter of neck portion 4*a* and stem 6 are designed to be in optimum relation such that the interval [(a−f)/2] of the inner diameter of neck portion 4*a* and outer circumference of stem 6 meets the condition of 0.2 mm≦(a−f)/2≦3.0 mm.

According to a second preferred embodiment of the present invention, when the inner diameter of neck portion 4*a* and outer diameter of stem 6 equal a and f, respectively, the inner diameter of neck portion 4*a* and the outer diameter of stem 6 equal 0.85 a mm≦f≦0.98 a mm.

In the first preferred embodiment of the present invention, the optimum space can be maintained, when designing on the basis of the interval between the inner diameter of neck portion 4*a* and the outer circumference of stem 6. In the second preferred embodiment of the present invention, when designing on the basis of the inner diameter of neck portion 4*a* and the outer diameter of stem 6, an interval between the inner diameter of neck portion 4*a* and the outer circumference of stem 6 can be optimally maintained.

If the space between the inner diameter of neck portion 4*a* and the outer circumference of stem 6 is larger than that of the above condition, heat intensity required during sealing in high. However, if high heat is applied, the fusing degree of neck portion 4*a* undesirably increases, while the viscosity of the neck portion material undesirably decreases and causes deformation of the neck portion 4*a* and stem 6.

As shown in FIG. 2A, the thickness of the joint of neck portion 4*a* and stem 6 is reduced to less than 50% of the thickness of neck portion 4*a,* thus being susceptible to cracking when evacuating the interior of the cathode ray tube.

If the space between the inner diameter of neck portion 4*a* and the outer surface of stem 6 is smaller than that of the above condition, the fusing operation is easily carried out during the sealing process, but the neck portion may be irregularly fused onto the joint, as shown in FIG. 2B. Thus, after sealing, the cathode ray tube is improperly mounted on the base (not shown) to thus cause inferiority of internal voltage characteristics and to make it difficult to mount deflection yoke 8 on the outer surface of neck portion 4*a*.

If the space between the inner diameter of neck portion 4*a* and the outer surface of stem 6 is much smaller, the inner walls of neck portion 4*a* may be scratched or damaged by the outer surface of stem 6.

According to a third preferred embodiment of the present invention, when the outer diameter of neck portion 4*a* in a cathode ray tube having neck portion 4*a* whose outer diameter is 23.0 to 28.5 mm and the thickness of neck portion 4*a* equal b and t, respectively, the outer diameter and thickness of neck portion 4*a* are in the range of 0.08 b mm≦t≦0.1 b mm.

In a slim cathode ray tube with the neck portion 4*a* having an outer diameter of 23.0 mm to 28.5 mm, if the outer diameter and thickness of neck portion 4*a* are not in proper relation, severe crack or oxidization of stem pin 9 occurs while stem 6 is being fused to neck portion 4*a,* thus resulting in an improper vacuum in the interior of the cathode ray tube.

As shown in FIG. 3A, if neck portion 4*a* is too thick, the heat consumption is increased during sealing whereas the strength of neck portion 4*a* is excellent. Also stem pins 9 are oxidized by the excessive heat consumption or projections 6*b* around stem pin 9 are damaged to decrease the internal voltage and internal insulation. Undesirable fragments of oxidized stem pins 9 stray in the cathode ray tube or obstruct holes of the shadow mask 3.

As shown in FIG. 3B, if neck portion 4*a* is too thin, acceptable tolerance against shocks and vibrations cannot be assured. Thus, the thickness t of neck portion 4*a* is designed to be adequately maintained on the basis of the outer diameter b of neck portion 4*a.*

According to a fourth preferred embodiment of the present invention, when the thickness of neck portion 4*a* and thickness of stem 6 equal t and T, respectively, the thickness of neck portion 4*a* and thickness T of stem 6 are in optimum relation to meet the following condition: $0.8\ t\ mm \leqq T \leqq 1.4\ t\ mm$.

If the thickness T of stem 6 and the thickness t of neck portion 4*a* are not in optimum relation, i.e. if the thickness of stem 6 is much thinner than the thickness of neck portion 4*a* as shown in FIG. 4A, stem 6 may be bent out of shape by the heat applied during sealing, or stem pin 9 may be severely oxidized to make it difficult to join stem 6 onto the base and cause a decrease in the internal voltage.

On the contrary, if stem 6 is much thicker than the thickness of neck portion 4*a,* neck portion 4*a* and stem 6 do not properly join together by the difference in the fusing degree to cause the internal voltage degradation, as shown in FIG. 4B. If their thickness is significant, the stress by heat is not evenly distributed to make a crack on the joint during exhaust stroke of the cathode ray tube.

The above preferred embodiments of the present invention can be voltage applying to a stem having one or two focus applied pins. The preferred embodiments of the present invention may be applied to a stem having a circular configuration of pin thereon, the circular configuration being 12.00 mm in diameter. When joining the stem 6 having the electron gun therein with the slim neck portion 4*a,* the outer diameter and inner diameter of neck portion 4*a,* the thickness of neck portion 4*a,* and the thickness of stem pin 9 are controlled to provide the optimum sealing, thus precluding cracks that may occur on the joint of the neck portion and stem during sealing.

In addition, the present invention prevents the stem pins from being oxidized during sealing. Oxidation of the stem pins would cause debris therefrom to stray in the cathode ray tube or obstruct holes to the shadow mask.

It will be apparent to those skilled in the art that various modifications and variations can be made in the cathode ray tube of the present invention without departing from the spirit or scope of the invention. Thus, it is intended that the present invention cover the modifications and variations of this invention provided they come within the scope of the appended claims and their equivalents.

What is claimed is:

1. A color cathode ray tube having:

a panel to which a fluorescent layer is applied, a neck portion with an electron gun, a funnel joined to the panel, and a stem with the electron gun sealed to the neck portion, wherein an outer diameter of the neck portion and a thickness of the neck portion equal b and t, respectively, satisfying the condition of $0.08\ b\ mm \leqq t \leqq 0.1\ b\ mm$, and an outer diameter of the neck portion is 23.0 to 28.5 mm.

2. The color cathode ray tube according to claim 1, wherein the number of focus applied pins fixed to the stem is one or two.

3. The color cathode ray tube according to claim 1, wherein the stem pin fixed to the stem forms a circle from the center of the stem, whose diameter is 12.00 mm.

4. A color cathode ray tube (CRT) having a panel to which a fluorescent layer is applied, a slim neck portion with an electron gun, a funnel joined to the panel, a stem with the electron gun sealed to the neck portion, and said neck portion having an outer diameter between 23 mm and 28.5 mm wherein, before said stem is sealed to said neck portion, said neck portion has an inner diameter of a mm, and said stem has an outer diameter of f mm being defined as $0.2\ mm \leqq (a-f)/2 \leqq 3.0\ mm$ and said neck portion has an outer diameter of b mm, and a thickness of t mm being defined as $0.08\ mm \leqq t \leqq 0.1\ b\ mm$.

5. The apparatus of claim 4, wherein:

the stem has said outer diameter of f mm being defined as $0.85*a\ mm \leqq f \leqq 0.98*a\ mm$.

* * * * *